US011871889B2

(12) United States Patent
Zhang et al.

(10) Patent No.: US 11,871,889 B2
(45) Date of Patent: Jan. 16, 2024

(54) CLEANING ROBOT

(71) Applicants: YUNJING INTELLIGENCE INNOVATION (SHENZHEN) CO., LTD., Shenzhen (CN); YUNJING INTELLIGENCE (SHENZHEN) CO., LTD., Shenzhen (CN)

(72) Inventors: Junbin Zhang, Shenzhen (CN); Weijing Lin, Shenzhen (CN); Minzhao Xie, Shenzhen (CN); Minhua Sheng, Shenzhen (CN); Yun Chen, Shenzhen (CN); Zhaoqun Zhu, Shenzhen (CN); Yu Ai, Shenzhen (CN); Xingyan Li, Shenzhen (CN)

(73) Assignees: YUNJING INTELLIGENCE INNOVATION (SHENZHEN) CO., LTD., Shenzhen (CN); YUNJING INTELLIGENCE (SHENZHEN) CO., LTD., Shenzhen (CN)

( * ) Notice: Subject to any disclaimer, the term of this patent is extended or adjusted under 35 U.S.C. 154(b) by 0 days.

(21) Appl. No.: 18/321,003

(22) Filed: May 22, 2023

(65) Prior Publication Data

US 2023/0284847 A1 Sep. 14, 2023

Related U.S. Application Data

(63) Continuation of application No. PCT/CN2022/111662, filed on Aug. 11, 2022.

(30) Foreign Application Priority Data

Sep. 17, 2021 (CN) ..... 202122265444.6
Sep. 17, 2021 (CN) ..... 202122265488.9

(51) Int. Cl.
*A47L 9/04* (2006.01)
*A47L 13/20* (2006.01)

(52) U.S. Cl.
CPC ..... *A47L 9/0477* (2013.01); *A47L 13/20* (2013.01); *A47L 2201/04* (2013.01)

(58) Field of Classification Search
CPC ..... A47L 2201/04; A47L 9/0477; A47L 13/20
See application file for complete search history.

(56) References Cited

U.S. PATENT DOCUMENTS 7,891,045 B2 * 2/2011 Kim ..... A47L 9/106 15/328
2006/0236492 A1 * 10/2006 Sudo ..... A47L 11/4072 15/319

(Continued)

FOREIGN PATENT DOCUMENTS

CN 105982611 A * 10/2016 ..... A47L 11/24
CN 105982621 A * 10/2016 ..... A47L 11/204

(Continued)

OTHER PUBLICATIONS

International Search Report issued in corresponding International application No. PCT/CN2022/111662, dated Jun. 12, 2022.
Written Opinion of the International Search Authority in corresponding International application No. PCT/CN2022/111662.

*Primary Examiner* — Marc Carlson

(57) ABSTRACT

Disclosed is a cleaning robot. The cleaning robot includes a body, a traveling assembly, a rolling brush assembly and a dust suction assembly. The traveling assembly, the rolling brush assembly and the dust suction assembly are arranged on the body. The dust suction assembly includes a dust box arranged in front of the rolling brush assembly in the advancing direction of the cleaning robot. The rolling brush assembly is configured for sweeping garbage on a ground. The dust box is configured for receiving garbage swept by the rolling brush assembly. The present application is beneficial to increasing the volume and storage space of the dust (Continued)

box, reducing the number of times of cleaning the dust box by the user, and improving the user experience.

17 Claims, 5 Drawing Sheets

(56) References Cited

U.S. PATENT DOCUMENTS

| | | | | |
|---|---|---|---|---|
| 2010/0037418 | A1* | 2/2010 | Hussey | G05D 1/0234 901/1 |
| 2018/0317724 | A1* | 11/2018 | Cheung | A47L 9/1409 |
| 2020/0121147 | A1* | 4/2020 | Izawa | A47L 11/4011 |
| 2020/0170468 | A1* | 6/2020 | Nakayama | G01N 1/02 |
| 2021/0030227 | A1* | 2/2021 | Mathieu | A47L 11/4058 |
| 2021/0089040 | A1* | 3/2021 | Ebrahimi Afrouzi | G05D 1/0248 |
| 2022/0066456 | A1* | 3/2022 | Ebrahimi Afrouzi | B25J 9/1697 |
| 2023/0248194 | A1* | 8/2023 | Han | A47L 9/00 15/319 |

FOREIGN PATENT DOCUMENTS

| | | | | | |
|---|---|---|---|---|---|
| CN | 105982625 | A | * | 10/2016 | A47L 11/24 |
| CN | 112998589 | A | | 6/2021 | |
| CN | 113197518 | A | | 8/2021 | |
| EP | 1961358 | A2 | | 8/2008 | |
| EP | 2407077 | A2 | * | 1/2012 | A47L 9/0477 |
| EP | 3424395 | A1 | | 1/2019 | |
| KR | 20060112947 | A | * | 11/2006 | |
| WO | WO-2012149575 | A2 | * | 11/2012 | A47L 11/24 |
| WO | WO-2018137408 | A1 | * | 8/2018 | A47L 11/28 |

* cited by examiner

CLEANING ROBOT

CROSS REFERENCE TO RELATED APPLICATIONS

The present application claims priority to Chinese Patent Application Nos. 202122265488.9 and 202122265444.6, both filed on Sep. 17, 2021, and entitled "Cleaning Robot". The disclosures of the fore-mentioned applications are incorporated herein for reference.

TECHNICAL FIELD

The present application relates to the technical field of robots, in particular to a cleaning robot.

BACKGROUND

A cleaning robot of the related art includes a body and a traveling assembly, a rolling brush assembly and a dust suction assembly all arranged on the body. The rolling brush assembly is for rising garbage on the ground, and the dust suction assembly includes a dust box for receiving the garbage risen by the rolling brush assembly. The dust box of the cleaning robot is disposed on a rear side of the rolling brush assembly along an advancing direction of the cleaning robot. However, the middle portion and/or the rear portion of the body along the advancing direction are generally provided with other main components, if the dust box is arranged on the rear side of the rolling brush assembly, the dust box will be affected by those other main components to have a limited volume and a limited storage space.

SUMMARY

According to one aspect of the present application, a cleaning robot is provided, which is beneficial to increasing the volume and storage space of a dust box. The cleaning robot includes a body, a traveling assembly, a rolling brush assembly and a dust suction assembly. The traveling assembly, the rolling brush assembly and the dust suction assembly are arranged on the body, the dust suction assembly includes a dust box arranged in front of the rolling brush assembly in the advancing direction of the cleaning robot, and the rolling brush assembly is configured for sweeping garbage on a ground, and the dust box is configured for receiving the garbage swept by the rolling brush assembly.

In an embodiment, the body includes a front portion, a middle portion, and a rear portion along the advancing direction of the cleaning robot, the cleaning robot further includes a mopping assembly arranged at the rear portion, two traveling assemblies are distributed on a left side and a right side of the body, each traveling assembly includes a traveling wheel, and two traveling wheels are oppositely arranged at the middle portion, and a center of gravity of the cleaning robot is located behind a connection line of rotation axes of the two traveling wheels.

In an embodiment, the mopping assembly includes a mopping module movable in an up-down direction and a pressure module, and the pressure module is configured to apply a downward force to the mopping module and make the rear portion of the body to bear an upward reaction force during cleaning the ground with the mopping module.

In an embodiment, two mopping modules are distributed on the left side and the right side of the rear portion of the body in parallel, and the center of gravity of the cleaning robot is located in front of a connection line of rotation axes of the two mopping modules in the advancing direction.

In an embodiment, a projection of the center of gravity of the cleaning robot on a horizontal plane is located in an external rectangular area of a projection of the mopping assembly on the horizontal plane.

In an embodiment, the cleaning robot further includes a radar assembly disposed on the body and behind the dust box.

In an embodiment, the cleaning robot includes two traveling assemblies distributed on a left side and a right side of a middle portion of the body, the rolling brush assembly is located between the two traveling assemblies in the left-right direction, and at least a portion of a projection of the rolling brush assembly is overlapped with projections of the two traveling assemblies on a plane perpendicular to the left-right direction.

In an embodiment, the dust suction assembly further includes a fan connected to the dust box through a dust suction pipe, the dust suction pipe is extended backwards along an inner side of any one of the two traveling assemblies and located above the rolling brush assembly, and the fan is arranged behind the traveling assembly in the advancing direction.

In an embodiment, each traveling assembly includes a traveling wheel and a traveling wheel driving mechanism for driving the traveling wheel to travel, the cleaning robot further includes a universal wheel arranged on the body and behind the traveling wheel in the advancing direction, and the universal wheel is configured for providing support for the cleaning robot in an advancing process.

In an embodiment, two traveling wheels and the universal wheel are arranged to form an isosceles triangle, and a projection of a center of gravity of the cleaning robot is located in a projection of the isosceles triangle on a plane perpendicular to an up-down direction.

In an embodiment, the cleaning robot further includes a mopping assembly located at a rear portion of the body, the mopping assembly includes two mopping members for cleaning the ground, and the two mopping members are arranged on a left side and a right side of the body in parallel and rotatable around vertical axes under driving of a rotation driving module, a gap is formed between rear sides of the two mopping members, and the universal wheel is at least partially located in the gap in the advancing direction.

In an embodiment, two traveling assemblies are respectively arranged on a left side and a right side of a middle portion of the body, the cleaning robot further includes a mopping assembly arranged at the middle portion of the body and behind the rolling brush assembly in the advancing direction, the mopping assembly includes two mopping members and a rotation driving module configured for cleaning the ground, and the two mopping members are arranged on a left side and a right side of the body in parallel and rotatable around vertical axes under driving of the rotation driving module, a rotation axis of each mopping member is located between traveling members of the two traveling assemblies, a maximum rotation radius of each mopping member is greater than a minimum distance between the rotation axis of the mopping member and a traveling member on a same side in the advancing direction.

In an embodiment, the cleaning robot further includes a mopping assembly arranged behind the rolling brush assembly in the advancing direction and a battery arranged on the body, and the battery is arranged between the rolling brush assembly and the mopping assembly or behind the mopping assembly along the advancing direction.

In an embodiment, the cleaning robot further includes a mopping assembly and a battery disposed on the body, two traveling assemblies are distributed on a left side and a right side of a middle portion of the body, each traveling assembly includes a traveling wheel, and a center of gravity of the battery is located behind a connection line of rotation axes of two traveling wheels along the advancing direction.

In an embodiment, the mopping assembly includes a mopping member and a driving module configured for lifting the mopping member and/or rotating the mopping member around a vertical axis, the battery is arranged in front of the driving module along the advancing direction, and the battery is disposed above the mopping member and a projection of the battery is at least partially overlapped with a projection of the mopping member on a plane perpendicular to the up-down direction.

In an embodiment, the rolling brush assembly includes a rolling brush housing, a rolling brush and a rolling brush driving motor, the rolling brush is arranged in the rolling brush housing, the rolling brush driving motor is arranged behind one end of the rolling brush housing in the advancing direction, and a projection of the rolling brush driving motor is at least partially overlapped with a projection of the battery on a plane perpendicular to a left-right direction.

In an embodiment, the cleaning robot further includes a radar assembly disposed on the body, the rolling brush assembly and the battery are disposed below the radar assembly, and a projection of the rolling brush assembly and a projection of the battery are at least partially overlapped with a projection of the radar assembly on a plane perpendicular to the up-down direction.

In an embodiment, the rolling brush assembly includes a rolling brush housing and a rolling brush arranged in the rolling brush housing, and a dust collecting port is formed at a front upper portion of the rolling brush housing, the dust box has a dust suction port corresponding to the dust collecting port, a rotation direction of the rolling brush during cleaning the ground is identical to a rotation direction of the traveling wheel, and the garbage on the ground enters the dust box from the dust collecting port and the dust suction port after being rose to an upper space of the rolling brush housing.

Since the dust box of the cleaning robot of the present application is arranged in front of the rolling brush assembly, the installation of the dust box will not be limited by the other main components arranged in the middle portion and/or the rear portion of the body in the advancing direction, thus the size and the storage space of the dust box are increased, the number of times of cleaning the dust box by the user is reduced, and the use experience of the user is improved.

DETAILED DESCRIPTION OF THE EMBODIMENTS

Figure 1:
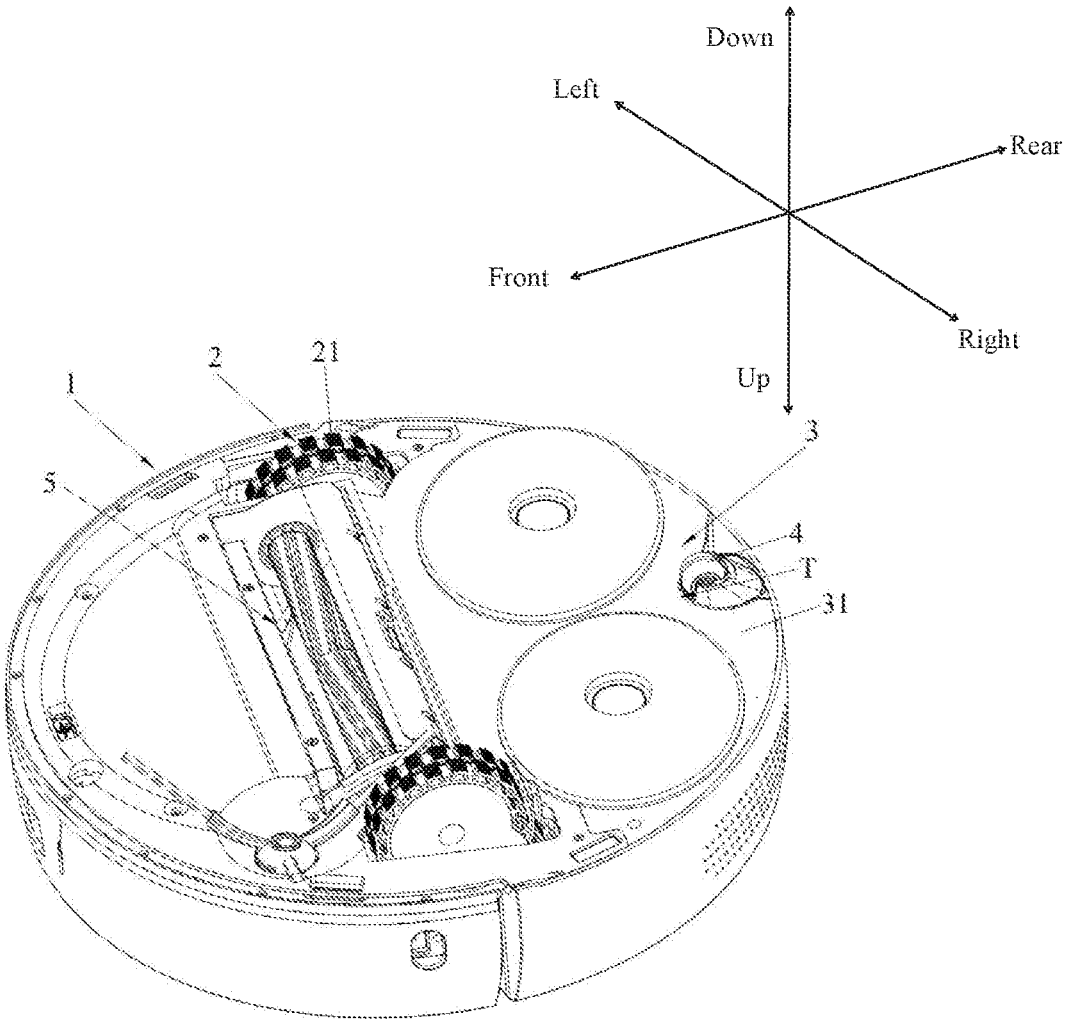
FIG. 1 is a schematic perspective view of a cleaning robot according to an embodiment of the present application.

In order to explain the technical content, construction features and implementations of the present application in detail, the following detailed description is given in conjunction with the embodiments and the accompanying drawings.

In the present application, "advancing direction" refers to a direction that a cleaning robot advances along a straight line in a horizontal plane. The terms "front," "rear," "left," "right," "upper" and "lower" are all defined in accordance with the advancing direction of the cleaning robot. "front" refers to a direction same as the advancing direction, and "rear" refers to a direction opposite to the advancing direction.

In addition, it can be understood by those skilled in the art that descriptions such as "B being provided in front of A", "D being provided behind C", and "B being provided between A and C" should not be interpreted absolutely (such as liking that B is located in front of the whole of A). For example, "a duct box 61 is provided in front of the rolling brush assembly 5" should not be interpreted that a dust box 61 is located in front of the whole rolling brush assembly very strictly, instead, the duct box 61 may also be located between two swing arms 512 of the rolling brush assembly 5. It will also be understood by those skilled in the art that the expressions such as "A and B being at least partially overlapped in a XY direction" in the present application mean that projections of A and B along the XY direction on a plane perpendicular to the XY direction are at least partially overlapped.

A cleaning robot of the related art includes a body and a traveling assembly, a rolling brush assembly and a dust suction assembly all arranged on the body. The rolling brush assembly is for rising garbage on the ground, and the dust suction assembly includes a dust box for receiving the garbage risen by the rolling brush assembly. The dust box of the cleaning robot is disposed behind the rolling brush assembly along an advancing direction of the cleaning robot. However, the middle portion and/or the rear portion of the body along the advancing direction are generally provided with other main components, if the dust box is arranged behind the rolling brush assembly, the dust box will be affected by those other main components to have a limited volume and a limited storage space.

In addition, the cleaning robot of the related art further includes a universal wheel and a mopping assembly. Driving wheels of two traveling assemblies are oppositely arranged in a middle portion of the body in the advancing direction of the cleaning robot, and the universal wheel is arranged at a front end of the body in the advancing direction. The mopping assembly is arranged at a rear portion of the body in the advancing direction. However, since the center of gravity of the cleaning robot of this type of cleaning robot of the related art is generally located at a front portion of the cleaning robot, it easily causes the cleaning robot to shake in some cases. For example, in the case that the mopping member of the mopping assembly is capable of rotating, the cleaning robot is easy to shake when a rotation speed of the mopping member is too fast (for example, the mopping member can rotate fast when being cleaned by the base station). For another example, when the mopping device needs to be cleaned by the base station, due to the usually existed strong relative movement between the mopping member of the mopping assembly and the cleaning device of the base station (including the situation that the mopping member does not move), the cleaning robot is easy to shake. In addition, in the case that the existing cleaning robot includes a mopping assembly and a rolling brush assembly and a dust box both located in front of the mopping assembly, the battery is placed in front of the rolling brush assembly and the dust box, which is not conductive to the arrangement of the dust box and the rolling brush assembly.

To this end, at least one aspect of the present application discloses a cleaning robot capable of cleaning the ground. For ease of understanding, the structure and working principle of the cleaning robot provided by the present application will be described in detail below with reference to FIG. 1 to FIG. 7.

As shown in FIG. 1 to FIG. 5, in some embodiments, the cleaning robot includes a body 1, and a traveling assembly 2, a rolling brush assembly 5 and a dust suction assembly 6 all disposed on the body 1.

The dust suction assembly 6 includes a dust box 61, and the dust box 61 is arranged in front of the rolling brush assembly 5 in an advancing direction of the cleaning robot. The rolling brush assembly 5 is configured for sweeping garbage on the ground, and the dust box 61 is configured for receiving the garbage swept by the rolling brush assembly 5. The "advancing direction" in the present application refers to a direction of the cleaning robot goes straight ahead.

Since the dust box 61 of the cleaning robot of the present application is disposed in front of the rolling brush assembly 5, the installation of the dust box 61 will not be limited by the other main components provided in a middle portion and/or a rear portion of the body 1, which is conductive to increasing the volume and storage space 612 of the dust box 61, reducing the number of times of cleaning the dust box 61 by a user, and improving the user experience.

Figure 2:
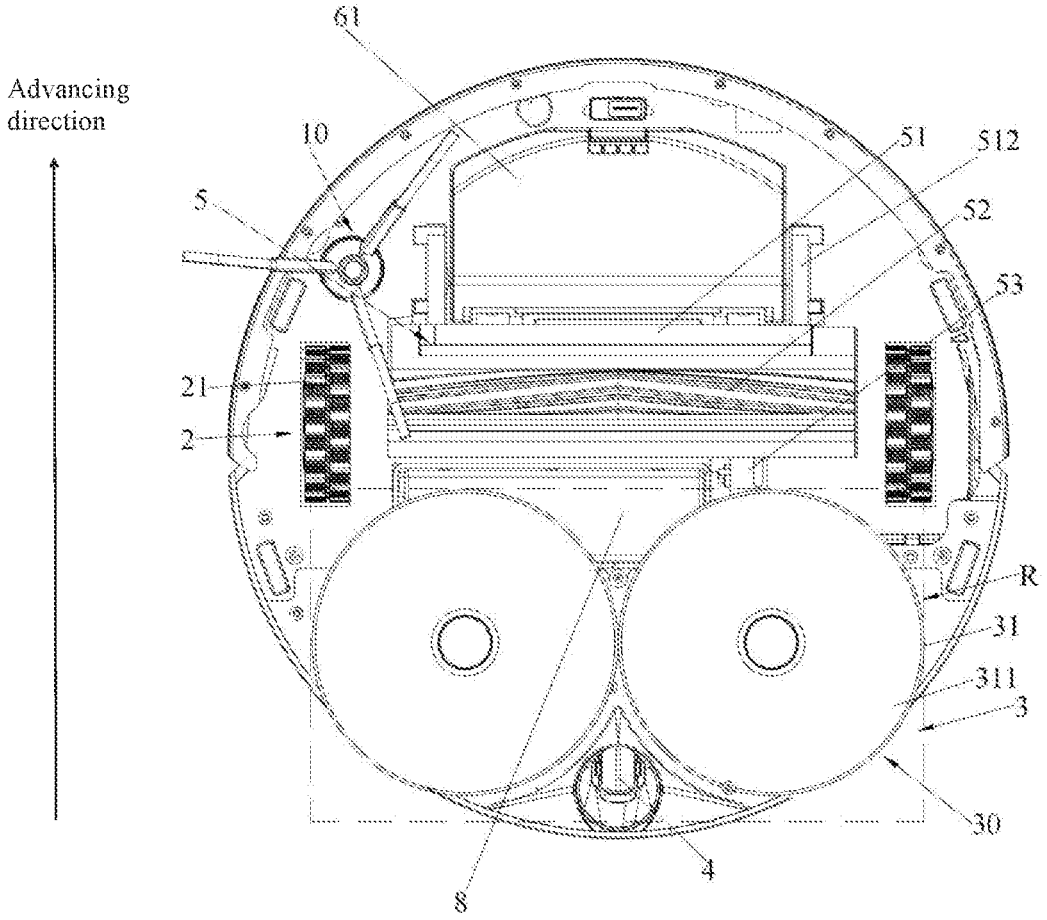
FIG. 2 is a bottom view of the cleaning robot of FIG. 1, with some portions removed.
Figure 4:
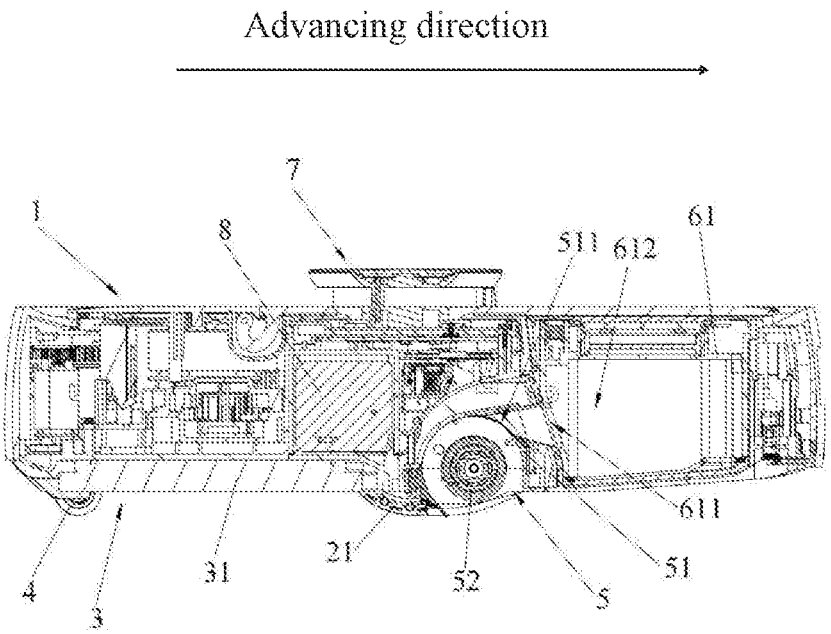
FIG. 4 is a cross-sectional view of the cleaning robot of FIG. 1.
Figure 6:
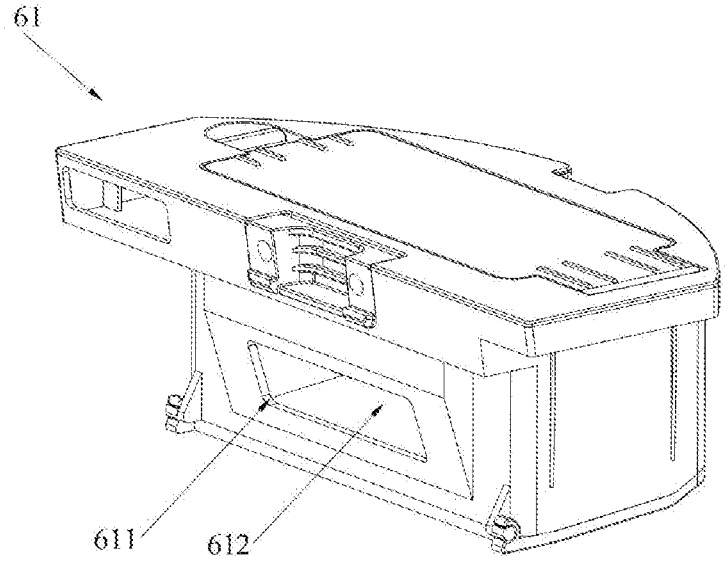
FIG. 6 is a schematic perspective view of a dust box according to an embodiment of the present application.

Referring to FIG. 2, FIG. 4 and FIG. 6, in some embodiments, the rolling brush assembly 5 includes a rolling brush housing 51, a rolling brush 52, and a rolling brush driving motor 53. The rolling brush housing 51 is provided with a dust collecting port 511, and the dust collecting port 511 is disposed corresponding to a dust suction port 611 of the dust box 61. The rolling brush 52 is rotatably disposed in the rolling brush housing 51. The rolling brush driving motor 53 is disposed on the rolling brush housing 51 and configured to drive the rolling brush 52 to rotate and clean the ground.

In an embodiment, the rolling brush housing 51 includes two swing arms 512 extending forward, and the two swing arms 512 are swingably connected to the body 1 to enable the rolling brush assembly 5 to swing up and down. A lower portion of the dust box 61 is located between the two swing arms 512, which is conductive to the compactness of the structure.

Specifically, along the advancing direction, the dust collecting port 511 is disposed on a front upper portion of the rolling brush housing 51. A rotation direction of the rolling brush 52 cleaning the ground is the same as a rotation direction of the travelling wheels 21 during the advancing process, and the garbage on the ground enters the dust box 61 from the dust collecting port 511 and the dust suction port 611 after being rose to an upper space of the rolling brush housing 51. Of course, when the dust box 61 is located in front of the rolling brush assembly 5, garbage collection is not limited to this manner. In addition, it is not excluded that the rolling brush 52 also has the function of cleaning the ground when rotating in a direction opposite to the above mentioned rotation direction, for example, when the cleaning robot is moving backward, the rotation direction of the rolling brush 52 can be reversed.

Figure 3:
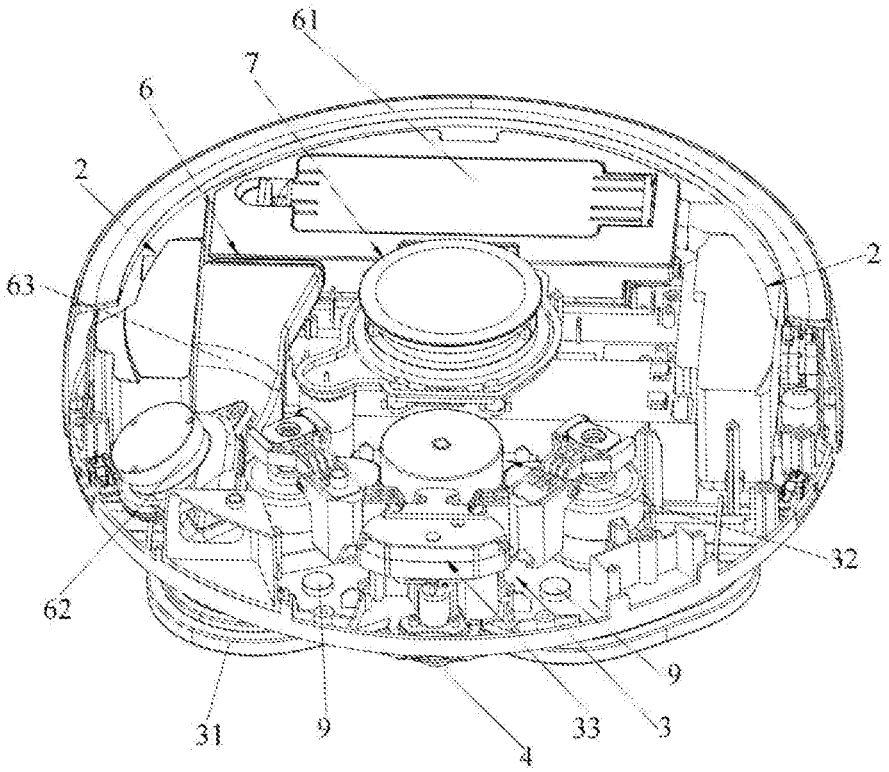
FIG. 3 is a schematic perspective view of the cleaning robot of FIG. 1 from another angle, with some portions removed.

Referring to FIG. 3, in an embodiment, the dust suction assembly 6 further includes a fan 62. The fan 62 is connected to the dust box 61 through a dust suction pipe 63 to vacuumize the dust box 61.

Referring to FIG. 3 and FIG. 4, the cleaning robot further includes a radar assembly 7 disposed on the body 1. The radar assembly 7 is disposed behind the dust box 61 along the advancing direction of the cleaning robot, which on the one hand can prevent affecting a detection effect of the radar assembly 7 due to that the radar assembly is located near the very front, and on the other hand can prevent occupying a space of a front upper portion of the body 1 by the radar assembly 7, a thickness of the dust box 61 is prevented from being limited by the radar assembly which occupies the space above the dust box 61, which is conductive to increasing the volume of the dust box 61.

In some embodiments, in an up-down direction, the radar assembly 7 is disposed above the rolling brush assembly 5 and at least partially overlapped with the rolling brush assembly 5, that is, the radar assembly 7 is disposed above the rolling brush assembly 5, and a projection of the radar assembly 7 is at least partially overlapped with a projection of the rolling brush assembly 5 on a plane perpendicular to the up-down direction. It can be understood that a rear portion of the body 1 is usually short of space due to the arrangement of other main components, the front portion of the body 1 is provided with the dust box 61, but a certain space above the rolling brush assembly 5 is available. Thus, a projection of the radar assembly 7 is at least partially overlapped with a projection of the rolling brush assembly 5 on a plane perpendicular to the up-down direction, which is conductive to the compactness of the structure.

Referring to FIG. 2 and FIG. 3, the cleaning robot includes two traveling assemblies 2 distributed on a left side and a right side of the middle portion of the body 1 (i.e, the middle portion along the advancing direction) respectively. Along a left-right direction, the rolling brush assembly 5 is located between the two traveling assemblies 2, and a projection of the rolling brush assembly 5 at least partially overlaps with projections of the two traveling assemblies 2 on a plane perpendicular to the left-right direction. Because that the rolling brush assembly 5 is located between the two traveling assemblies 2 and projections of the three are at least partially overlapped on a plane perpendicular to the left-right direction, the rolling brush assembly 5 is prevented from being located near the very front. As a result, the structure is compact, an available space for mounting the dust box 61 in front of the rolling brush assembly 5 is increased, and the dust box 61 can have a larger volume.

In some embodiments, each traveling assembly 2 includes a traveling wheel 21 and a traveling wheel driving mechanism for driving the traveling wheel 21 to walk. Of course, the traveling assembly 2 is not limited to this form, for example, the traveling assembly 2 may also be in the form of a track drive.

In an example, the body 1 is circular, and a connection line for connecting rotation axes of the traveling wheels 21 on the two sides may be located on a diameter of the body 1 perpendicular to the advancing direction, or may be located ahead of the diameter or behind the diameter for a suitable distance. Of course, in other embodiments, it is not excluded that the connection line is not perpendicular to the advancing direction.

In an embodiment, the cleaning robot further includes a universal wheel 4 arranged on the body 1. Along the advancing direction, the universal wheel 4 is located behind the traveling wheels 21. The universal wheel 4 provides support for the cleaning robot during the advancing process. Compared with that the universal wheel 4 is located at the front portion of the body 1, for the universal wheel 4 is located behind the traveling wheel 21 along the advancing direction, the front portion of the body 1 is not occupied by the universal wheel 4, which is conductive to reserving a larger space for mounting the dust box 61 and increasing the volume of the dust box 61.

Further, the two traveling wheels 21 and the universal wheels 4 are arranged to form an isosceles triangle, which is beneficial to the balance of the cleaning robot.

In some embodiments, the dust suction assembly 6 further includes a fan 62. The fan 62 is connected to the dust box 61 through a dust suction pipe 63. The dust suction pipe 63 is extended backwards along an inner side of a traveling assembly 2 and located above the rolling brush assembly 5. The inner side of the traveling assembly 2 refers to a side of the traveling assembly 2 facing the rolling brush assembly 5. Along the advancing direction, a fan 62 is provided behind the traveling assemblies 2, which is conductive to a reasonable layout of the fan 62 and the dust suction pipe 63, and improving the compactness of the overall structure.

In some embodiments, the cleaning robot further includes a side brush assembly 10 mounted on the body 1. The side brush assembly 10 is disposed on at least one of two corners formed by the dust box 61, the rolling brush assembly 5, and the traveling assemblies 2. The side brush assembly 10 sweeps the garbage on the ground to the rolling brush assembly 5 and the rolling brush assembly 5, and the dust suction assembly 6 finally collect the garbage into the dust box 61.

Referring to FIG. 2 to FIG. 4, in some embodiments, the cleaning robot further includes a mopping assembly 3 arranged on the body 1. The mopping assembly 3 is provided behind the rolling brush assembly 5 along the advancing direction. The dust box 61 is distributed on a side of the rolling brush assembly 5 in a front-back direction and the mopping assembly 3 is distributed on the other side of the rolling brush assembly 5 in the front-back direction, which avoids a smaller available space for mounting the dust box 61 resulted from that the dust box 61 is located between the mopping assembly 3 and the rolling brush assembly 5, especially when the projection of the radar assembly 7 is at least partially overlapped with the projection of the rolling brush assembly 5 on a plane perpendicular to the up-down direction. Therefore, arranging the dust box 61 in front of the rolling brush assembly 5 is beneficial to increasing the volume of the dust box 61. Moreover, since the dust box 61 is lighter than the rolling brush assembly 5, the center of gravity of the cleaning robot can be moved backwards by arranging the dust box 61 in front of the rolling brush assembly 5. In addition, since the rolling brush assembly 5 is arranged between the dust box 61 and the mopping assembly 3, the rolling brush assembly 5 is closer to the diameter of the cleaning robot when the cleaning robot is circular, so that the rolling brush assembly 5 can have a larger length. In this case, compared to the arrangement of arranging the rolling brush assembly 5 at the front portion of the body 1, a cleaning range that can be covered by the rolling brush assembly 5 in the movement process of the cleaning robot is larger. Thus, not only the volume of the dust box 61 is increased, but also the cleaning range is expanded.

In some embodiments, the mopping assembly 3 includes a mopping module 30 and a rotation driving module 32. The mopping module 30 can rotate under the driving of the rotation driving module 32 to clean the ground with the mopping member 31 thereof. It should be noted that when the mopping module 30 is rotatable, the rotation manner of the mopping module 30 is not limited. For example, the mopping module 30 may be rotated around a vertical axis or around a horizontal axis. In addition, the mopping assembly 3 is not limited to any form. For example, the mopping assembly 3 may not include the rotation driving module 32, and accordingly, the mopping member 31 will not rotate when cleaning the horizontal ground.

In an embodiment, the mopping assembly 3 includes two mopping members 31 which are distributed on the left side and the right side of the body 1 side by side and can rotate around a respective vertical axis under the driving of the rotation driving module 32. A gap T is formed between rear sides of the mopping members 31. In the advancing direction, the universal wheel 4 is at least partially located in the gap T, which is conductive to the compactness of the structure of the cleaning robot. It should be noted that each of the two mopping members 31 may be driven by a respective independent rotation driving module 32, or the two may be driven by a common rotation driving module 32.

In an embodiment, each mopping member 31 includes a turntable 311 connected to the corresponding rotation driving module 32 and a mop (not shown) disposed on the turntable 311.

In an exemplary example, in the advancing direction, the universal wheel 4 is disposed behind the mopping members 31 and at least partially located in the gap T, which is conductive to the compactness of the structure of the cleaning robot.

Further, rotation axes of the two mopping members 31 are located between the traveling members of the two traveling assemblies 2. The maximum rotation radius of each mopping member 31 is greater than the minimum distance between the rotation axis of each mopping member 31 and a corresponding traveling member on the same side (the two are both on the left side or both on the right side) along the advancing direction. As such, not only the compactness of the structure is improved, but also the mopping members 31 can be used to clean the traveling traces of the traveling wheels 21.

In some embodiments, the maximum rotation radius of each mopping member 31 is not less than the distance between the rotation axis of the mopping member 31 and an outer edge of a rolling surface of a traveling member on the same side in the left-right direction, and less than the minimum distance between the rotation axis of the mopping member 31 and the traveling member on the same side. The compactness of the structure is realized, meanwhile, the mopping member 31 can be used to clean the traveling traces of the traveling member. In an embodiment, the traveling member may be, but is not limited to, the traveling wheel 21.

Referring to FIG. 3, in some embodiments, the mopping assembly 3 further includes a lifting driving module 33 for lifting or lowering the mopping module 30. "lowering the mopping module" is not limited to directly driving the mopping module 30 to be lowered, for example, it may be that the mopping module 30 loses support and falls down, as long as the mopping module 30 goes down due to the action of the lifting driving module 33.

Figure 5:
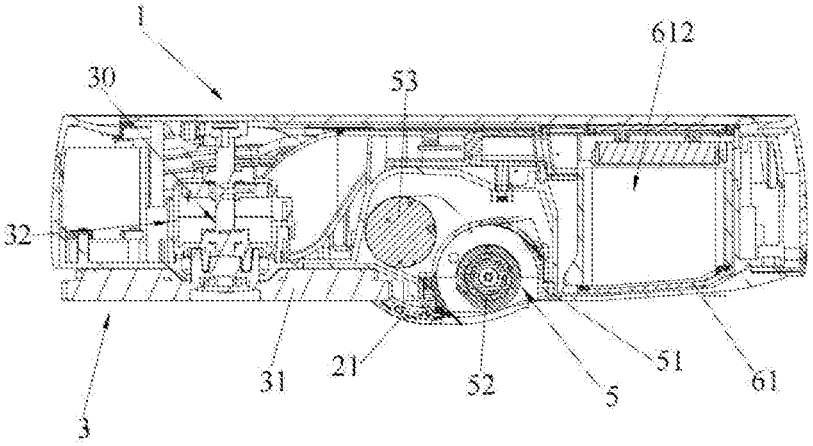
FIG. 5 is another cross-sectional view of the cleaning robot of FIG. 1.

Referring to FIG. 2, FIG. 4 and FIG. 5, the cleaning robot further includes a battery 8 disposed in the body 1, and the battery 8 is disposed behind the rolling brush assembly 5 in the advancing direction. Thus the area in front of the rolling brush assembly 5 is available to serve as a dust box mounting area, which is helpful for the increase of the volume and the storage space 612 of the dust box 61. At the same time, in the advancing direction, the center of gravity of the battery 8 is located behind the connection line of the rotation axes of the two traveling wheels 21. For the cleaning robot, the battery 8 is a heavier component, thus locating the center of gravity of the battery 8 behind the connection line of the rotation axes of the two traveling wheels 21 is beneficial to moving the center of gravity of the cleaning robot rearwards, as compared with the cleaning robot in the related art.

In some embodiments, the cleaning robot further includes the mopping assembly 3 arranged on the body 1, and the battery 8 is arranged in front of the mopping assembly 3 in the advancing direction. Of course, the position of the battery 8 is not limited to this, in some other embodiments, the battery 8 may be arranged behind the mopping assembly 3 as long as the position of the battery 8 is beneficial to moving the center of gravity of the cleaning robot backwards and meanwhile not too far away from the connection line of the rotation axes of the two traveling wheels 21 to not affect obstacle-climbing capability of the cleaning robot.

In an embodiment, the battery 8 is arranged between the connection line of the rotation axes of the two traveling wheels 21 and the mopping assembly 3. Since the battery 8 is arranged between the mopping assembly 3 and the rolling brush assembly 5 in the advancing direction, the space utilization rate of the cleaning robot is improved, and the volume of the cleaning robot is reduced.

In an embodiment, the mopping assembly 3 includes the mopping members 31 and a driving module capable of lifting or lowering each mopping member 31 and/or rotating each mopping member 31 about a vertical axis. In the advancing direction, the battery 8 is provided in front of the driving module, and at least portion of a projection of the battery 8 overlaps with the projection of each mopping member 31 on a plane perpendicular to the up-down direction. In other words, referring to FIG. 4, since the mopping member 31 is extended forward to beyond the driving module, the battery 8 may be provided partially in the space in front of the driving module and above the mopping member 31, thereby facilitating to make full use of the mounting space of the body 1 and improving the compactness of the overall structure. Of course, the battery 8 is not limited to be disposed in front of the driving module, for example, in the advancing direction, the battery 8 may be disposed behind the driving module and at least partially overlapped with the driving module.

In an embodiment, the driving module includes a lifting driving module 33 and a rotation driving module 32, and the mopping member 31 has functions of lifting and rotating.

Further, the rolling brush assembly 5 includes a rolling brush housing 51, a rolling brush 52 and a rolling brush driving motor 53. The rolling brush 52 is arranged in the rolling brush housing 51. In the advancing direction, the rolling brush driving motor 53 is arranged behind one end of the rolling brush housing 51. Further, at least portion of a projection of the rolling brush driving motor 53 is overlapped with the projection of the battery 8 on a plane perpendicular to the left-right direction, so that the space utilization of the cleaning robot can be further improved, and the volume of the cleaning robot is reduced.

In an example, at least portion of the projection of rolling brush drive motor 53 is overlapped with the projection of the rotatable mopping member 31 on a plane perpendicular to the up-down direction to make full use of the space.

In some embodiments, the cleaning robot further includes a radar assembly 7 provided in the body 1. The rolling brush assembly 5 and the battery 8 are arranged below the radar assembly 7. At least portion of the projection of the rolling brush assembly 5 and at least portion of the projection of the battery 8 are overlapped with a projection of the radar assembly 7 on a plane perpendicular to the up-down direction, thereby improving the space utilization of the cleaning robot and reducing the volume of the cleaning robot. By arranging the dust box 61 at the front, it can avoid the restriction of the radar assembly 7 on the mounting space of the dust box 61 when the dust box 61 is arranged on the rear side of the rolling brush assembly 5, thereby facilitating to increase the size of the dust box 61.

Referring to FIG. 3, the cleaning robot further includes a counterweight block 9, which is provided at a tail portion of the body 1 in the advancing direction. The counterweight block 9 is arranged at the tail portion of the body 1, so that the centre of gravity of the cleaning robot can be moved backwards with the counterweight block 9 of a small weight, which is beneficial to accurately adjusting the position of the center of gravity of the cleaning robot according to needs. Specifically, the tail portion of the body 1 is the rearmost part of the body 1, and the rear portion of the body 1 may include the tail portion of the body 1 and a portion of area in front of the tail portion.

At least one aspect of the present application further provides a cleaning robot, which includes the mopping assembly. The body includes a front portion, a middle portion, and a rear portion along the advancing direction of the cleaning robot. The two traveling assemblies are arranged on the left side and the right side of the body respectively and each traveling assembly includes a traveling wheel. Two traveling wheels are oppositely arranged in the middle portion of the body in the advancing direction. The mopping assembly is arranged at the rear portion of the body, and the center of gravity of the cleaning robot is located behind the connection line of the rotation axes of the two traveling wheels.

Due to that the battery is arranged behind the rolling brush assembly and the dust box, the battery does not need to occupy the area of the front portion of the body, which is conductive to the arrangement of the dust box and the rolling brush assembly. At the same time, as compared to arranging the battery in front of the rolling brush assembly and the dust box, arranging the battery, which is a heavier component of the cleaning robot, behind the rolling brush assembly and the dust box is beneficial to changing the position of the centre of gravity of the cleaning robot.

In some embodiments, as shown in FIG. 1 to FIG. 5, in the advancing direction, the middle portion of the body 1 is provided with the two traveling wheels 21 opposite to each other, the rear portion of the body 1 is provided with the mopping assembly 3, and the center of gravity of the cleaning robot is located behind the connection line of the rotation axes of the two traveling wheels 21.

As compared to locating the centre of gravity of the cleaning robot in front of the connection line of the rotation axes of the two traveling wheels 21 in the advancing direction, in the present application, locating the center of gravity of the cleaning robot behind the connection line of the rotation axes of the two traveling wheels 21 in the advancing direction helps to suppress the shaking of the cleaning robot.

In this embodiment, the front portion, the middle portion and the rear portion of the body 1 are divided according to the advancing direction of the cleaning robot, and a portion where the two traveling wheels 21 locate in the advancing direction can be defined as the middle portion of the body 1. It can be understood that the above-mentioned "mopping assembly 3 being located at the rear portion of the body 1" does not mean that the whole of the mopping assembly 3 must be located behind the two traveling wheels 21. It also includes that the projections of the two on a plane perpendicular to the left-right direction are partially overlapped, for example, mops of the mopping assembly 3 may extend partially between the two traveling wheels 21 in the advancing direction.

Figure 7:
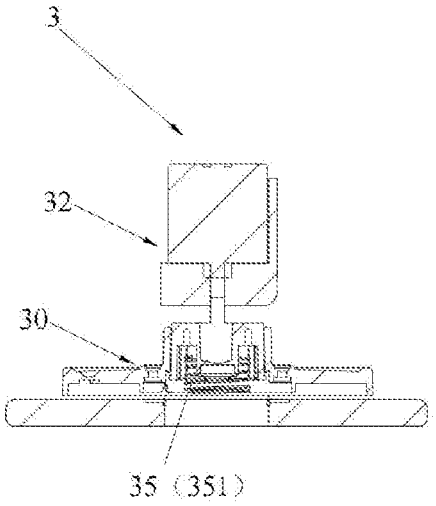
FIG. 7 is a schematic cross-sectional view of a mopping assembly according to an embodiment of the present application.

Referring to FIG. 7, the mopping assembly 3 includes the mopping module 30 and a pressure module 35. The mopping module 30 is movable in the up-down direction. When the mopping module 30 cleans the ground, the pressure module 35 is configured to apply a downward force to the mopping module 30 and make the rear portion of the body 1 bear an upward reaction force. Without considering other factors, in theory, when the mopping module 30 cleans the horizontal ground, the pressure borne by the ground is equal to the gravity of the mopping module 30 plus the downward force of the pressure module 35. Accordingly, the ground will exert an upward reaction force of the same size on the mopping module 30. A portion of the upward reaction force is applied to the rear portion of the body 1 through the pressure module 35. Since the center of gravity of the cleaning robot is located on the rear side of the connection line of the rotation axes of the two traveling wheels 21 in the advancing direction, the rear portion of the cleaning robot has been assigned with a larger gravity (as compared to that the center of gravity of the cleaning robot is arranged at the front portion), and after the reaction force applied by the pressure module 35 is counteracted, a certain size of downward force is still reserved, thus the situation that the rear portion of the cleaning robot is prone to uplift due to the centre of gravity of the cleaning robot located at the front portion can be avoided.

In some embodiments, the pressure module 35 includes an elastic member 351. The elastic member 351 is disposed between the body 1 and the mopping module 30. When the cleaning robot cleans the ground, the mopping module 30 is moved upward by the ground and stores elastic potential energy. At this time, the pressure borne by the ground is equal to the gravity of the mopping module 30 plus the downward elastic force of the elastic member 351 acting on the mopping module 30, and a portion of the reaction force of the ground acts on the rear portion of the body 1 through the elastic member 351.

It should be noted that "the elastic member 351 being disposed between the body 1 and the mopping module 30" is not limited to that the elastic member 351 is directly disposed between the body 1 and the mopping module 30. For example, in the embodiment shown in FIG. 7, the mopping assembly 3 further includes the rotation driving module 32 for driving the mopping module 30 to rotate, the mopping module 30 is axially movably connected to an output end of the rotation driving module 32, and the elastic member 351 is disposed between the mopping module 30 and the output end of the rotation driving module 32. When the elastic member 351 is in a compressed state, the elastic force of the elastic member 351 directly acts on the rotation driving module 32 and is transmitted to the body 1.

It can be understood that, in different embodiments, the components of the mopping module may be different. For example, in some embodiments, the mopping module may include a mopping member and a rotating shaft connected to the mopping member, the rotating shaft is connected to the rotation driving module and can move relative to the rotation driving module in an axial direction. At this time, the elastic member, which serves as the pressure module, may be disposed between the mopping member and the rotation driving module, or be disposed between the rotating shaft and the body, or be disposed in another form. In other embodiments, the mopping module may include the mopping member and exclude the rotating shaft which is connected to the mopping member and axially movable relative to the rotation driving module. At this time, the elastic member, which serves as the pressure module, may be disposed between the mopping member and the rotation driving module, or of course, may be disposed in another manner. In addition, when the mopping module cleans the horizontal ground, the mopping module may be rotated about a vertical axis or a horizontal axis, or there is no relative movement between the mopping module and the cleaning apparatus, etc.

It can be understood that the pressure module is not limited to be an elastic member, and the pressure module may be another structure capable of playing a similar effect.

In summary, the form and arrangement of the above-mentioned pressure module may be various, as long as the cleaning robot is capable of applying a downward force to the mopping module and the rear portion of the body bears an upward reaction force. Of course, in some other embodiments, when the pressure module applies the downward force to the mopping module, the pressure module does not necessarily apply an upward reaction force to the body of the mopping module.

Referring to FIGS. 2 and 3, the mopping assembly 3 includes the mopping module 30 and the rotation driving module 32, and the rotation driving module 32 is configured to drive the mopping module 30 to rotate. When the center of gravity of the cleaning robot is located at the front portion of the cleaning robot, the cleaning robot is easy to shake if the mopping module 30 rotates too fast. For example, when the mopping member 31 of the mopping module 30 is cleaned by a base station, a rapid rotation of the mopping device 31 causes rubbing between the mopping member 31 and a cleaning apparatus of the base station. At this time, the cleaning robot may shake due to too fast rotation of the mopping member 31. Of course, when the mopping member 31 is cleaned by the base station, the mopping member 31 may be cleaned using movement of the mopping member 31 and together with the movement of the cleaning apparatus or simply using the movement of the cleaning apparatus. If the movement(s) is(are) relatively intense, the cleaning robot may shake. By locating the center of gravity of the cleaning robot behind the connection line of the rotation axes of the two traveling wheels 21 in the advancing direction, it is helpful to improve the situation that the cleaning robot is prone to shaking as compared with locating the center of gravity of the cleaning robot at the front portion of the cleaning robot.

In some embodiments, two mopping modules 30 are arranged on the left side and the right side of the rear portion of the body 1 in parallel, and each mopping module 30 can rotate about a vertical axis when cleaning the horizontal ground. The two mopping modules 30 may share a rotation driving module 32, or may be driven by a respective independent rotation driving module.

In an embodiment, in the advancing direction, the center of gravity of the cleaning robot is located in front of a connection line of rotation axes of the two mopping modules 30. According to the present application, since the center of gravity of the cleaning robot is located behind the connection line of the rotation axes of the two traveling wheels 21 and in front of the connection line of the rotation axes of the two mopping modules 30, the problem that the cleaning robot is easy to shake caused by locating the centre of gravity at the front portion can be solved as much as possible.

Referring to FIG. 2 and FIG. 3, in the advancing direction, a universal wheel 4 is provided behind the mopping member 31. The universal wheel 4 provides support for the cleaning robot during the advancing process. Since the center of gravity of the cleaning robot is relatively rearward, the rear side of the mopping member 31 is provided with the universal wheel 4 for guiding and supporting the cleaning robot, which is beneficial to improving the traveling stability of the cleaning robot.

In an embodiment, the mopping member 31 is disposed between the connection line of the rotation axes of the two traveling wheels 21 and the universal wheel 4.

In an embodiment, the two traveling wheels 21 and the universal wheels 4 are distributed to form an isosceles triangle. A projection of the center of gravity of the cleaning robot on a plane perpendicular to the up-down direction is located in a projection of the isosceles triangle on the plane, which is beneficial to keeping the cleaning robot in balance.

In some embodiments, the mopping assembly 3 includes the mopping member 31, and a battery 8 is arranged above the mopping member 31. At least portion of a projection of the battery 8 is overlapped with a projection of the mopping member 31 on a plane perpendicular to the up-down direction. Therefore, the battery 8 can be at least partially provided in the space above the mopping member 31, thereby facilitating to make full use of the mounting space of the body 1 and improving the compactness of the overall structure.

In some embodiments, the driving module includes a rotation driving module 32 and a lifting driving module 33, and the mopping member 31 has functions of lifting and rotating.

In some embodiments, a projection of the center of gravity of the cleaning robot on the horizontal plane is located in an external rectangular area R of the projection of the mopping assembly 3 on the horizontal plane. Through this technical means, when the mopping assembly 3 applies pressure to the ground by means of the gravity of the cleaning robot, it is beneficial to increase the pressure of the mopping assembly 3 on the ground, thereby facilitating to improve the mopping effect.

With further reference to FIG. 1 to FIG. 7, an embodiment of the present application discloses a cleaning robot, which includes a body 1, a traveling assembly 2, a mopping assembly 3, a rolling brush assembly 5, a dust suction assembly 6 and a battery 8. The traveling assembly 2, the mopping assembly 3, the rolling brush assembly 5, the dust suction assembly 6 and the battery 8 are all arranged on the body 1. The dust suction assembly 6 includes a dust box 61. The rolling brush assembly 5 is configured for sweeping garbage on the ground, and the dust box 61 is configured for receiving the garbage swept by the rolling brush assembly 5. In the advancing direction of the cleaning robot, the mopping assembly 3 and the battery 8 are provided behind the rolling brush assembly 5 and the dust box 61. The "traveling assembly 2" may be, but is not limited to, a driving wheel assembly; for example, it may also be a track assembly.

Due to that the battery 8 is arranged behind the rolling brush assembly 5 and the dust box 61 in the advancing direction, the battery 8 does not need to occupy the area of the front portion of the body 1, thereby facilitating the arrangement of the dust box 61 and the rolling brush assembly 5.

At the same time, the battery 8, which is a heavier component of the cleaning robot, is disposed behind the rolling brush assembly 5 and the dust box 61. As compared to locating the battery 8 in front of the rolling brush assembly 5 and the dust box 61, it is beneficial to changing the position of the centre of gravity of the cleaning robot. When the center of gravity of the cleaning robot needs to be moved backwards, it is easy to meet the needs through the above arrangement.

In the advancing direction, the battery 8 is arranged in front of or behind the mopping assembly 3, that is, the battery 8 may be disposed in front of or behind the mopping assembly 3 according to the layout needs.

In some embodiments, the mopping assembly 3 includes a mopping member 31, and the battery 8 is arranged above the mopping member 31. A projection of the battery 8 is at least partially overlapped with a projection of the mopping member 31 on a plane perpendicular to the up-down direction, thereby facilitating to make full use of the mounting space of the body 1 and improving the compactness of the overall structure.

In an embodiment, the mopping assembly 3 further includes a driving module capable of lifting the mopping member 31 and/or rotating the mopping member 31 about a vertical axis. The mopping member 31 is connected to a bottom end of the driving module. The battery 8 is arranged in front of the driving module in the advancing direction, and a projection of the battery 8 is at least partially overlapped with a projection of the driving module on a plane perpendicular to the advancing direction. In other words, the mopping member 31 is extended forward to beyond the driving module, thus the battery 8 can be at least partially disposed in the space before the driving module and above the mopping member 31, which is helpful to make full use of the mounting space of the body 1 and improve the compactness of the overall structure. Of course, the battery 8 is not limited to being disposed in front of the driving module, for example, in the advancing direction, the battery 8 may also be disposed behind the driving module and at least partially overlaps with the driving module.

In an example, the driving module includes a rotation driving module 32 and a lifting driving module 33, and the mopping member 31 has functions of lifting and rotating.

Further, in the advancing direction, the dust box 61 is arranged in front of the rolling brush assembly 5. The battery 8 is arranged between the mopping assembly 3 and the rolling brush assembly 5. The dust box 61 is arranged at the front portion of the body 1 to increase the size of the dust box 61, so that the dust box 61 has a larger storage space and more garbage can be contained in the dust box 61. Since the dust box 61 is lighter than the rolling brush assembly 5, the center of gravity of the cleaning robot can be moved backwards by arranging the dust box 61 in front of the rolling brush assembly 5. In an embodiment, the rolling brush assembly 5 includes two swing arms 512 extending forward, and the two swing arms 512 are swingable and connected to the body 1, so that the rolling brush assembly 5 can swing up and down. The lower portion of the dust box 61 is located between the two swing arms 512, which is helpful for the compactness of the structure.

In some embodiments, the rolling brush assembly 5 includes a rolling brush housing 51, a rolling brush 52 and a rolling brush driving motor 53. The rolling brush 52 is arranged in the rolling brush housing 51, and the rolling brush driving motor 53 is arranged behind one end of the rolling brush housing 51 in the advancing direction. A projection of the rolling brush driving motor 53 at least partially overlaps with a projection of the battery 8 on a plane perpendicular to the left-right direction, so that the space utilization of the cleaning robot can be further improved, and the volume of the cleaning robot is reduced.

In an embodiment, a projection of the rolling brush driving motor 53 at least partially overlaps with a projection of the vertically rotatable mopping member 31 on a plane perpendicular to the up-down direction, so as to make full use of the space.

In some embodiments, the traveling assembly includes two traveling wheels 21. In the advancing direction, the middle portion of the body 1 is provided with the two traveling wheels 21, and the center of gravity of the battery 8 is located behind the connection line of the rotation axes of the two traveling wheels 21. Since the center of gravity of a traditional cleaning robot is located in front of the connection line of the rotation axes of the two traveling wheels 21, compared with the traditional cleaning robot, locating the center of gravity of the battery 8 behind the connection line of the rotation axes of the two traveling wheels 21 is conductive to moving the center of gravity of the cleaning robot backwards.

In some embodiments, the mopping assembly 3 includes the mopping member 31 for cleaning the ground, and the cleaning robot further includes a universal wheel 4 arranged on the body 1. The universal wheel 4 is disposed behind the mopping member 31 in the advancing direction, and the universal wheel 4 provides support for the cleaning robot during the advancing process. Since the center of gravity of the cleaning robot of the present disclosure is rearward relative to the traditional cleaning robot, disposing the universal wheel 4 for guiding and supporting the cleaning robot behind the mopping member 31 is beneficial to improving the traveling stability of the cleaning robot.

In an embodiment, the mopping member 31 is disposed between the connection line of the rotation axes of the two traveling wheels 21 and the universal wheel 4.

In some embodiments, the cleaning robot further includes a radar assembly 7 provided in the body 1. The battery 8 is arranged below the radar assembly 7. A projection of the battery 8 is at least partially overlapped with a projection of the radar assembly 7 on a plane perpendicular to the up-down direction, which is beneficial to the compactness of the structure. In an embodiment, a projection of a rear portion of the radar assembly 7 overlaps with at least a portion of a projection of the battery 8 on a plane perpendicular to the up-down direction. Further, in the advancing direction, the rolling brush assembly 5 is provided behind the dust box 61, and a projection of a front portion of the radar assembly 7 overlaps with at least a portion of a projection of the rolling brush assembly 5 on a plane perpendicular to the up-down direction, which is beneficial to the compactness of the structure.

In some embodiments, the center of gravity of the battery 8 is located in an external rectangular area of a projection of the mopping assembly 3 on the horizontal plane. Through this technical means, when the mopping assembly 3 applies pressure to the ground by means of the gravity of the cleaning robot, it is beneficial to increase the pressure of the mopping assembly 3 on the ground, thereby facilitating to improve the mopping effect.

In some embodiments, the mopping assembly 3 includes the mopping module 30 and a pressure module 35. The mopping module 30 is movable in the up-down direction. When the mopping module 30 cleans the ground, the pressure module 35 is configured to apply a downward force to the mopping module 30 and make the rear portion of the body 1 bear an upward reaction force. Since the aforementioned arrangement of the battery 8 results in moving the center of gravity of the cleaning robot backwards, the rear portion of the cleaning robot has been assigned with a larger gravity (as compared with a traditional cleaning robot); after counteracting the reaction force applied by the pressure module 35, the rear portion of the body 1 still bears a certain size of downward force, thus the situation that the rear portion of the cleaning robot is prone to uplift due to the centre of gravity of the cleaning robot located at the front portion can be avoided as much as possible.

In some embodiments, the mopping assembly 3 includes the mopping module 30 and a rotation driving module 32, and the rotation driving module 32 is configured to drive the mopping module 30 to rotate. Since the aforementioned arrangement of the battery 8 results in moving the center of gravity of the cleaning robot backwards, the situation that the cleaning robot is easy to shake due to too fast rotation of the mopping module 30 or too fast rotation of the mopping module 30 relative to the cleaning device of the base station can be avoided as much as possible.

The above disclosure is only optional examples of the present application, and the function thereof is to facilitate a person skilled in the art to understand and implement the present application, and certainly it cannot be used to limit the scope of the present application. As a result, the equivalent changes made as recited in claimed scope of the present application are still within the claimed scope of the present application.

What is claimed is:

1. A cleaning robot comprising:

two traveling assemblies;

a rolling brush assembly configured for sweeping garbage on a ground;

a dust suction assembly comprising a dust box arranged in front of the rolling brush assembly in an advancing direction of the cleaning robot, the dust box being configured for receiving the garbage swept by the rolling brush assembly; and a body, the traveling assemblies, the rolling brush assembly and the dust suction assembly being all arranged on the body;

wherein the two traveling assemblies are distributed on a left side and a right side of a middle portion of the body, the rolling brush assembly is located between the two traveling assemblies in a left-right direction, and at least a portion of a projection of the rolling brush assembly is overlapped with projections of the two traveling assemblies on a plane perpendicular to the left-right direction.

2. The cleaning robot of claim 1, wherein, the body comprises a front portion, a middle portion, and a rear portion along the advancing direction of the cleaning robot; and the cleaning robot further comprises:

a mopping assembly arranged at the rear portion; and two traveling assemblies distributed on a left side and a right side of the body, each traveling assembly comprising a traveling wheel, two traveling wheels being oppositely arranged at the middle portion, wherein, a center of gravity of the cleaning robot is located behind a connection line of rotation axes of the two traveling wheels.

3. The cleaning robot of claim 2, wherein the mopping assembly comprises a mopping module movable in an up-down direction and a pressure module, and the pressure module is configured to apply a downward force to the mopping module and make the rear portion of the body to bear an upward reaction force during cleaning the ground with the mopping module.

4. The cleaning robot of claim 3, wherein two mopping modules are distributed on a left side and a right side of the rear portion of the body in parallel, and the center of gravity of the cleaning robot is located in front of a connection line of rotation axes of the two mopping modules in the advancing direction.

5. The cleaning robot of claim 2, wherein a projection of the center of gravity of the cleaning robot on a horizontal plane is located in an external rectangular area of a projection of the mopping assembly on the horizontal plane.

6. The cleaning robot of claim 1, wherein the cleaning robot further comprises a radar assembly disposed on the body and behind the dust box.

7. The cleaning robot of claim 1, wherein the dust suction assembly further comprises a fan connected to the dust box through a dust suction pipe, the dust suction pipe is extended backwards along an inner side of any one of the two traveling assemblies and located above the rolling brush assembly, and the fan is arranged behind the traveling assembly in the advancing direction.

8. The cleaning robot of claim 1, wherein, each traveling assembly comprises a traveling wheel and a traveling wheel driving mechanism for driving the traveling wheel to travel, the cleaning robot further comprises a universal wheel arranged on the body and behind the traveling wheel in the advancing direction, and the universal wheel is configured for providing support for the cleaning robot in an advancing process.

9. The cleaning robot of claim 8, wherein two traveling wheels and the universal wheel are arranged to form an isosceles triangle, and a projection of a center of gravity of the cleaning robot is located in a projection of the isosceles triangle on a plane perpendicular to an up-down direction.

10. The cleaning robot of claim 8, wherein, the cleaning robot further comprises a mopping assembly located at a rear portion of the body, the mopping assembly comprises two mopping members for cleaning the ground, and the two mopping members are arranged on a left side and a right side of the body in parallel and rotatable around vertical axes under driving of a rotation driving module, a gap is formed between rear sides of the two mopping members, and the universal wheel is at least partially located in the gap in the advancing direction.

11. The cleaning robot of claim 1, wherein, two traveling assemblies are respectively arranged on a left side and a right side of a middle portion of the body; and the cleaning robot further comprises a mopping assembly arranged at the body and behind the rolling brush assembly in the advancing direction, the mopping assembly comprising:

two mopping members arranged on a left side and a right side of the body in parallel and configured for cleaning the ground, a rotation axis of each mopping member being located between traveling members of the two traveling assemblies, a maximum rotation radius of each mopping member is greater than a minimum distance between the rotation axis of the mopping member and a traveling member on a same side in the advancing direction; and a rotation driving module configured for driving the two mopping members to rotate around vertical axes.

12. The cleaning robot of claim 1, further comprising a mopping assembly arranged behind the rolling brush assembly in the advancing direction and a battery arranged on the body, wherein the battery is arranged between the rolling brush assembly and the mopping assembly or behind the mopping assembly along the advancing direction.

13. The cleaning robot of claim 1, further comprising a mopping assembly and a battery disposed on the body, wherein two traveling assemblies are distributed on a left side and a right side of a middle portion of the body, each traveling assembly comprises a traveling wheel, and a center of gravity of the battery is located behind a connection line of rotation axes of two traveling wheels along the advancing direction.

14. The cleaning robot of claim 12, wherein the mopping assembly comprises a mopping member and a driving module configured for lifting the mopping member and/or rotating the mopping member around a vertical axis, the battery is arranged in front of the driving module along the advancing direction, the battery is disposed above the mopping member and a projection of the battery is at least partially overlapped with a projection of the mopping member on a plane perpendicular to the up-down direction.

15. The cleaning robot of claim 14, wherein the rolling brush assembly comprises a rolling brush housing, a rolling brush and a rolling brush driving motor, the rolling brush is arranged in the rolling brush housing, the rolling brush driving motor is arranged behind one end of the rolling brush housing in the advancing direction, and a projection of the rolling brush driving motor is at least partially overlapped with a projection of the battery on a plane perpendicular to a left-right direction.

16. The cleaning robot of claim 12, further comprising a radar assembly disposed on the body, wherein the rolling brush assembly and the battery are disposed below the radar assembly, and a projection of the rolling brush assembly and a projection of the battery are at least partially overlapped with a projection of the radar assembly on a plane perpendicular to the up-down direction.

17. The cleaning robot of claim 1, wherein the rolling brush assembly comprises:

a rolling brush housing, a dust collecting port being formed at a front upper portion of the rolling brush housing; and a rolling brush arranged in the rolling brush housing, a rotation direction of the rolling brush during cleaning the ground being identical to a rotation direction of the traveling assembly, wherein:

the dust box has a dust suction port corresponding to the dust collecting port; and the garbage on the ground enters the dust box from the dust collecting port and the dust suction port after being rose to an upper space of the rolling brush housing.

* * * * *